United States Patent [19]

Rothenberg

[11] Patent Number: 4,491,845

[45] Date of Patent: Jan. 1, 1985

[54] WIDE ANGLE PHASED ARRAY DOME LENS ANTENNA WITH A REFLECTION/TRANSMISSION SWITCH

[75] Inventor: Carl Rothenberg, N. Bellmore, N.Y.

[73] Assignee: The United States of America as represented by the Secretary of the Air Force, Washington, D.C.

[21] Appl. No.: 444,003

[22] Filed: Nov. 23, 1982

[51] Int. Cl.[3] ..... H01Q 19/06; H01Q 3/46; H01Q 1/28

[52] U.S. Cl. ..... 343/754; 343/778; 343/376

[58] Field of Search ..... 343/753–756, 343/909, 910, 911 R, 911 L, 371, 372, 374, 376, 705, 708, 776–778, 786, 872

[56] References Cited

U.S. PATENT DOCUMENTS

| | | | |
|---|---|---|---|
| Re. 28,217 | 10/1974 | Malech | 343/754 |
| 3,484,784 | 12/1969 | McLeod, Jr. | 343/755 |
| 3,524,188 | 8/1970 | Bowman | 343/754 |
| 3,550,139 | 12/1970 | McFarland | 343/754 |
| 3,755,815 | 8/1973 | Stangel | 343/754 |
| 4,070,678 | 1/1978 | Smedes | 343/754 |

*Primary Examiner*—Eli Lieberman
*Assistant Examiner*—Michael C. Wimer
*Attorney, Agent, or Firm*—Donald J. Singer; Bernard E. Franz

[57] ABSTRACT

An antenna assembly configured by the combination of the high forward gain of a conventional planar phased array antenna with the wide angle scanning capability of a dome antenna. The invention includes an optically fed phased array, which may be structurally configured similar to a conventional lens array, but comprises a reflection/transmission switch and an electronic phase shifter at each radiating element. The switches facilitate operation of the phased array in two distinct modes; when the switches are set for the transmission mode, the phased array operates substantially as a conventional lens array to scan a ±60° conical sector; when the switches are set for the reflection mode, the phased array behaves like a reflect array to scan an additional ±60° to ±120° sector.

7 Claims, 4 Drawing Figures

WIDE ANGLE PHASED ARRAY DOME LENS ANTENNA WITH A REFLECTION/TRANSMISSION SWITCH

RIGHTS OF THE GOVERNMENT

The invention described herein may be manufactured and used by or for the Government of the United States for all governmental purposes without the payment of any royalty.

BACKGROUND OF THE INVENTION

The present invention relates to electronically steerable antennas in general, and in particular to such antennas having a reflector assembly and phased array elements with alternate transmission/reflection operating modes.

Reflector type antennas are well known in the radar antenna art. Typically, such an antenna would have a dipole, slot, or a horn, called the primary feed aperture, radiating toward a large reflector called the secondary aperture. The large reflector is used to shape the radiated wave to produce the desired pattern. Reflector antennas generally provide a single beam and may be scanned only by mechanical means. One important advantage of the reflector type is that they are relatively inexpensive and can be utilized over wide mechanical scan angles. A variance of the reflector type of antenna is the lens antenna, which has a direct analog to an optical lens. Such lenses are used primarily for converting a spherical wave into a plane wave on the opposite side of the lens, the wave being refracted as it passes through the lens. These lenses may be designed using the principles of classical geometric optics.

Phased array antennas are also well known in the art. This type has an array of elements such as dipoles in which the signal feeding each dipole is varied in such a way that antenna beams can be formed in space and scanned very rapidly in azimuth and elevation. Phased array antennas are useful for tracking multiple targets or targets that possess great speed as the beam can be steered electronically rather than mechanically, as in the case of the reflector or lens antennas. In addition, phased array antennas can simultaneously track a plurality of targets by producing time-shared radar beams, such a feature is extremely difficult with mechanically scanned reflector or lens assemblies. Furthermore, the conventional reflector antenna has little or no side lobe or beam shape control while phased arrays may be designed with adaptive side lobe and beam shape control and hence can achieve a highly superior performance characteristic.

With respect to military aircraft, fire-control radars are used to aid the pilot with target detection, tracking, and aiming of rockets, missiles and other weapons. Such radars rely on their antennas to provide early detection and precision tracking of a plurality of threats and targets over an extremely wide angle of coverage. Additionally, given the high speed of today's modern aircraft, high gain of the antenna system is essential for early detection. The invention disclosed herein combines the advantages of both a phased array antenna and a reflector and lens antenna to satisfy the need of rapid beam scanning with wide angular coverage and high gain in a single antenna assembly.

Prior work in this area includes U.S. Pat. No. Re. 28,217 which discloses an electronically steerable antenna formed by an array of separate reflector units of controllable electrical path length. The units each receive energy from a source which is reflected at a phase corresponding to the electrical path of the corresponding unit. Also, U.S. Pat. No. 4,070,678 discloses a wide angle scanning antenna assembly including a switching matrix and a spherical electromagnetic lens. In addition, U.S. Pat. No. 3,755,815 teaches a scanning antenna employing a phased array antenna directing electromagnetic energy through a non-planar lens. While each of these patents is suitable for its intended purpose, neither patent combines the features of a reflector antenna with a phased array antenna to produce configuration suitable for use with a fire control radar.

SUMMARY OF THE INVENTION

An object of this invention is to provide an improved wide angle scanning phased array antenna assembly with high gain characteristics.

According to the invention, an antenna feed horn is located at the zenith of a dome antenna such that it radiates into a phased array antenna situated at the opening of the dome. Each radiating element of the phased array has both an electronic phase shifter and a reflection/transmission switch. For wide angle scanning operation, the switches are set for the reflection mode, causing the phased array to radiate into the dome with the antenna beam propogating through the dome at wide angles. With the switches set for the transmission mode, the phased array operates substantially as a conventional lens array.

DETAILED DESCRIPTION

Figure 1:
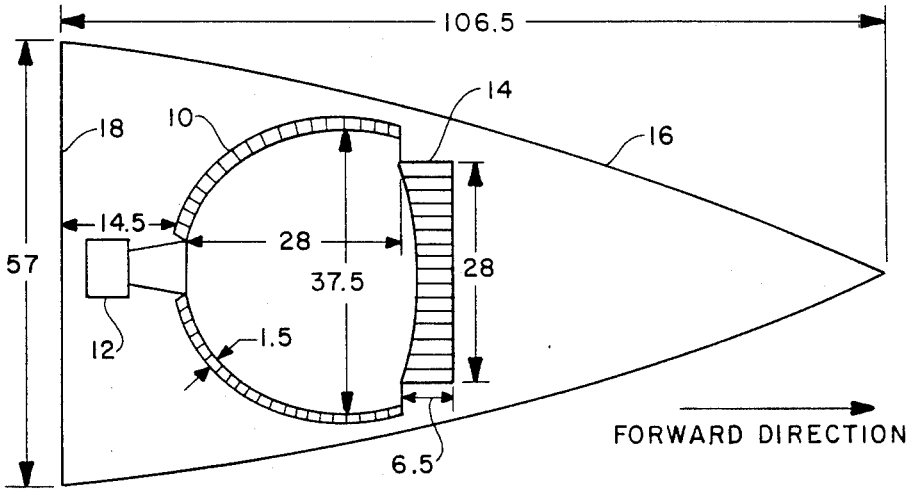
FIG. 1 is a cross-sectional view of a specific embodiment of the invention.

Referring now to FIG. 1, a specific embodiment of the antenna assembly is shown which allows a beam of radio frequency energy to be scanned in any desired direction within a volume of approximately $3\pi$ steradians without any mechanical rotation of the antenna assembly. A refractive lens type of antenna in the shape of a hemisphere or dome antenna 10 is shown along with a feed horn 12 located such that it radiates energy from the zenith of the dome. A phased array reflector/lens antenna 14 is placed immediately in front of the opening in the dome. As will be described in greater detail later, dome 10 comprises a plurality of dome elements, and the phased array 14 comprises a plurality of radiating elements, each controlled by a ferrite phase shifter and switch. The assembly may be housed within a radome 16 having conventional ogive geometry substantially as shown in the drawing and attached to an aircraft's bulkhead 18. Typical dimensions of the components are shown in FIG. 1, with the units in inches.

To describe the invention, a specific embodiment will be detailed based upon specific requirements. The invention, however, is not limited to the use of the specific hardware described. The dome 10, for a specific embodiment, is a conventional passive constrained lens of a modified hemispheric shape containing 8980 discrete dome element modules. The modules are spaced approximately at one-half wavelength on a triangular-to-rectangular lattice, consistent with criteria for eliminating planar array grating lobes. Each dome module consists of a stripline collector element, radiator element, and fixed phase delay section. A finite number of different phase delay types are used, consistent with allowable phase error tolerances. The radiator elements are chosen so that the module is insensitive to polarization and can be designed to provide, if required, a transformation between incident and transmitted polarization. The refractive properties of the dome are determined by the arrangement of module phase styles along the surface. This establishes the phase gradients which determine the scan altering characteristics and the achievable dome antenna gain performance. Each of the stripline dome modules is $0.55\times0.55\times1.0$ inch in size and the unit weight is 0.012 pound. These units are grouped into several preformed subarrays to facilitate assembly into the dome structure.

The dome structure is a fiberglass sandwich construction consisting of 0.030 inch thick quarts fabric/F174 polymide skins with a $\frac{3}{8}$-inch thick core of glass-reinforced polymide honeycomb. This produces a dome structure with outer diameter of 40.5 inches and overall height of 29.5 inches. A flange on the dome structure provides for attachment to the phase array feed.

In the specific embodiment of this invention, the dome 10 is in the shape of a hollow shell with ogive geometry, that is a cross-sectional view of the dome would show a pattern created by joining the arcs of two circles separated by a distance large enough for a feed horn. The height of the ogive dome is approximately equal to the phased array diameter. This satisfies the requirement that the aperture gain at $\pm60$ degrees to $\pm120$ degrees from the forward direction is within 3 to 4 dB of the feed array gain and provides that all incident angles are less than 60 degrees. The term "feed array" refers to the phased array antenna but is used to indicate that the phased array is being used in the reflect mode to feed the signal to the dome antenna.

The feed and comparator assembly 12 is a standard brazed aluminum waveguide assembly with a two-horn feed which provides a sum and two difference channels for linearly polarized monopulse tracking radars. The unit is $7\times7\times12$ inches and weighs 5 pounds. Waveguide connections through the bulkhead provide the interface to the transmitter and receiver microwave units.

The phased array reflector/lens antenna 14 consists of an array of 1532 equidistant radiating elements. The relative amplitude and phase of the signals applied to each of the elements of the feed array on the input side are controlled to obtain the desired antenna pattern from the combined action of all the elements. The phased array antenna 14 is essentially a conventional device but with an important modification. This invention's phased array combined a reflection/transmission switch with a conventional electronic phase shifter at each radiating element. Following the feeding of the RF energy from the feed/comparator unit to the phased array, these switches facilitate the operation of the phased array in two distinct modes: When the switches are set for transmission, the phased array will operate as a conventional lens array, maximizing gain along the antenna axis and facilitating high gain electronic scan coverage in the forward sector with the usual cosine drop-off characteristic of conventional planar arrays. When the switches are set for reflection, the phased array becomes a reflect array. Electromagnetic energy radiated from the feed 12 is received by the collector elements, and is phased and reflected back toward the dome structure. This reflected energy then irradiates the dome antenna where it is refracted to provide electronic scan coverage in a 360 degree toriodal sector at wide angles to the antenna axis. With switches in the transmission position, a phased array lens configuration is achieved to scan the forward $\pm60$ degree conical sector. With switches in the reflection position, a reflector array configuration is achieved which utilizes the dome to provide gain coverage in the $\pm60$ to $\pm120$ degree scan sector. This configuration is capable of scanning $3\pi$ steradians or 75 percent of the spherical volume around an aircraft.

The phased array reflector/lens antenna 14 utilizes electronically variable phase shifters operating in both the transmit and reflect modes. Either operating mode is selectable and depends upon the particular application.

A latching reciprocal ferrite phase shifter employing Faraday rotation in tandem with a Faraday rotator ferrite switch is used for the specific embodiment. In the transmit mode, the RF signal propagates through both the phase shifter and the switch. In the reflect mode, the switch effectively places a short circuit across the output of the phase shifter to reflect the RF signal.

Figure 2:
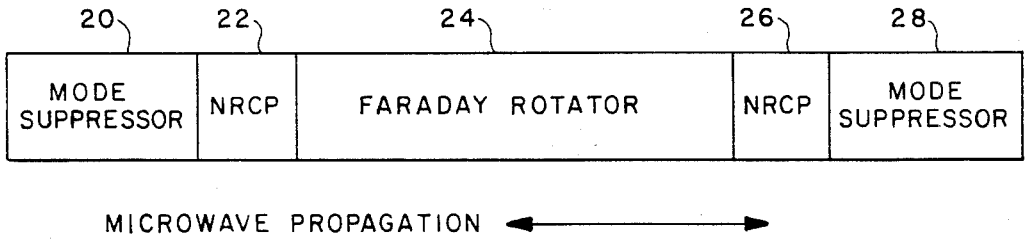
FIG. 2 is a block diagram of a phase shifter employed by the phased array antenna.

The dual-mode latching reciprocal phase shifter is shown in the block diagram of FIG. 2. The basic components are a mode suppressor 20 for use at an entry or exit port, coupled to a non-reciprocal circular polarizer (NRCP) 22, coupled to a Faraday rotator 24 (or phase shift section), coupled to a second non-reciprocal circular polarizer (NRCP) 26, coupled a second and final mode suppressor 28 for use at a second entry/exit port. Microwave propagation can occur in either direction as the antenna assembly is used for both transmit and receive. All components are standard components. No matching sections, radiating elements, or switching yokes are shown because they are not basic to the operation of the device.

Consider linearly polarized microwave energy incident on the left mode suppressor 20, which consists of a resistive vane across the waveguide. The incident field is perpendicular to the vane, minimizing the loss. The NRCP 22 converts the linearly polarized wave to a circularly polarized wave, which then propagates through Faraday rotator 24 and is phase shifted proportional to the static H field, sense of polarization, and direction of propagation. The phase shifted circularly polarized wave is subsequently reconverted to linear polarization by a second NRCP 26, the phase shifted microwave signal then emerges from the right side at the second mode suppressor 28, attenuated only by the loss of the mode suppressors, NRCP's, and Faraday rotator.

A linearly polarized wave incident on the right side and propagating to the left will be converted to circular polarization of the opposite sense in the NRCP 26 and phase shifted by the same amount as the energy propagating towards the right, because both the sense of polarization and the direction of propagation have changed. The following NRCP 22 converts the circular polarization back to linear, and this wave emerges from the left side, phase shifted by the same amount as the wave traveling toward the right. The mode suppressors are required to prevent small errors in the NRCP's from causing reflections at the ends of the device which would manifest themselves as insertion loss spikes.

The dual-mode phase shifter makes use of Faraday rotation to obtain phase shift. This allows the guide to be heavily loaded with ferrite material, and to be operated sufficiently far from cut-off to minimize phase sensitivity. Due to the shorter ferrite section, the dual-mode phase shifter has a higher figure of merit than any other reciprocal ferrite device.

For more information on latching reciprocal phase shifters, see "A Dual-Mode Latching Reciprocal Ferrite Phase Shifter" by C. Boyd, Jr., IEEE Transactions on Microwave Theory and Techniques, Vol. MTT-18, No. 12, December 1970, p. 1119. Also see "Application of Reciprocal Latching Ferrite Phase Shifters to Lightweight Electronic Scanned Phased Arrays" by W. Hord et al, Proceedings of the IEEE, Vol. 56, No. 11, November 1968, p. 1931.

Figure 3:
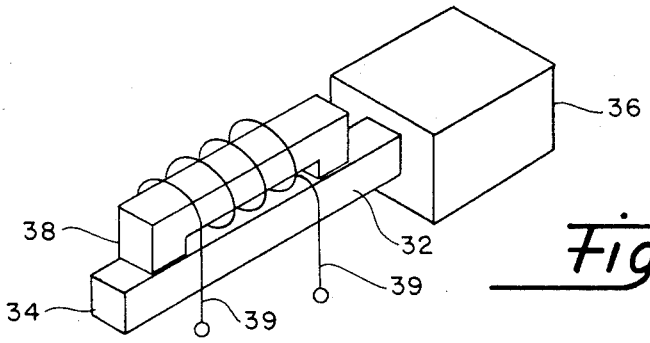
FIG. 3 is a perspective view of a switch utilized by the specific embodiment.

The phase shifter may be operated in either the transmit or reflect mode by placing a SPST switch in tandem with the phase shifter. A latching Faraday rotator switch is selected for the specific arrangement, as shown in FIG. 3, and includes a metallized square ferrite bar 32 with one end serving as an input 34 from the dual mode phase shifter (coupled through the mode suppressor). The other end of the ferrite bar terminates with a waveguide section 36. A ferrite yoke 38 with control winding 39 (coupled to the common phase shifter/switch drive) is placed adjacent to the ferrite bar to create a magnetic field. Legs at each end of the yoke terminate at the bar. The waveguide section propagates in the transmission mode and reflects in the alternate mode. With the applied magnetic field in one direction, the input to the Faraday rotator is rotated so that the plane of the output electric field corresponds to the transmission mode, and hence is transmitted through the waveguide section with small attenuation. Reversal of the direction of the magnetic field causes the electric field to be Faraday rotated by 90 degrees, setting up the reflect mode, and hence reflection from the waveguide section.

Typical characteristics of the phase shifter and switch combination for the specific embodiment are shown in the following table.

| Parameter | Transmit | Reflect |
|---|---|---|
| Center Frequency | 9.5 GHz | 9.5 GHz |
| Bandwidth | ± 2½% | ± 2½% |
| Power | 115 watts peak<br>12 watts average | 200 watts peak<br>20 watts average |
| Polarization | linear | linear |
| Phase shift | 360° 6-bit accuracy<br>LSB = 5.63° | 360° 5-bit accuracy<br>LSB = 11.25° |
| Phase error | (a) 15° rms at $f_o$<br>(b) ± 6° over frequency | (a) 25° rms at $f_o$<br>(b) ± 10° over frequency band |
| Insertion loss | 1.1 dB average | 2 dB average |
| Loss modulation | ± 0.2 dB | ± 0.3 dB |
| Isolation | N.A. | (a) 20 dB min. at $f_o$<br>(b) 15 dB min. over frequency band |
| Switching speed | 140 us max | 150 us max |
| Switching Energy | 350 uj/cycle max | 350 uj/cycle max |

The X-band radome 16 is 106.5 inches in length with a maximum diameter of 57 inches. The design uses half-wavelength wall thickness to achieve efficient transmission for large incident angles. A lightweight structure is obtained using a loaded foam core which matches the dielectric constant of the quartz fabric reinforced polymide resin skins. The core is a syntactic foam with glass micro-balloons, polymide resin, short lengths of glass fibre, and aluminum flakes in a lightweight mixture. The composite wall approximates a dielectric constant 3.2 which results in a nominal structure thickness of 0.35 inch. The ratio of skin thickness (the two skins may be unequal thicknesses) to core thickness is selected to satisfy the aircraft structural and thermal requirements and could, if necessary, be a solid wall of the above thickness in a limit design near the aircraft bulkhead. The radome would be fabricated in two sections of approximately equal length, connected at a flange which supports the phased array, and dome. The phase shifters and drivers could be serviced by removal of the forward radome section.

The present antenna assembly technique combines the wide angle scanning capability of a conventional dome antenna with the higher broadside gain capability of a planar array. The design uses only the phased array to scan ±60 degrees in the forward sector and employs the full dome antenna for scanning the remaining sector from ±60 degrees to a maximun of ±120 degrees from the forward direction.

Figure 4:
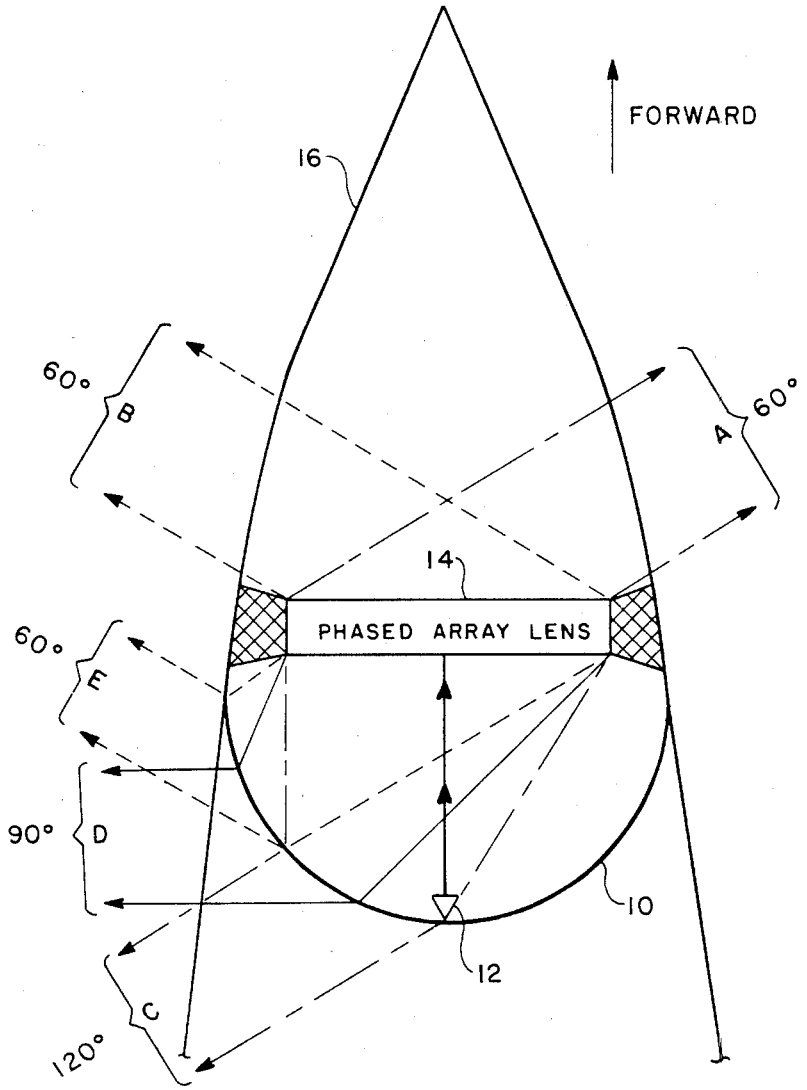
FIG. 4 is another cross-sectional view of the specific embodiment showing the RF energy paths.

FIG. 4 shows a cross-sectional view of the specific embodiment and is similar to FIG. 1 except that it shows the paths that the electromagnetic energy follows and their associated geometries. Points A and B show the scan angular coverage in the forward sector, A being a +60 degrees from a center axis passing perpendicularly through the phased array 14 and through the feed horn 12, while point B represents −60 degrees. The remaining sector of 60 to 120 degrees is shown by points C, D, and E. These points represent the scanning coverage available during the reflection mode and show the refraction operation. The exact angle to which the radar beam points is determined by phasing control of the phased array.

For the specific embodiment parameters, a lens array gain loss of 4.0 dB is incurred in the forward scan sector to ±60 degrees. This loss includes contributions due to the feed and comparator spillover, illumination taper, phase shifters, radiating elements, and phase and amplitude error losses. The relative gain, as compared to isotropic, is 33.5 dBi at a scan angle of zero degrees and reduces to 30.5 dB at a scan angle of ±60 degrees. There is an additional loss of 1.6 dB for the dome-reflector array sector from ±60 to ±120 degrees. This includes 0.7 dB for dome loss and 0.9 dB for the phase shifter in the reflector array switch position. A transverse aperture gain variation of the form $\cos(|\theta|-60)$ is used for the scan angle range of ±60 to ±120 degrees. The gain varies from 28.3 dB at 60 degrees, to 28.9 dB at 75 degrees, and reduces to 25.7 dB at 120 degrees.

The beamwidth of the specific embodiment varies as a function of scan angle for both the axial and azimuthal planes. The axial plane is one which contains the dome axis of symmetry, and the aximuthal plane is perpendicular to this axis. The relative beamwidth factor is normalized to the broadside feed array beamwidth which is 3.0 degrees for the conceptual design. In the forward ±60-degree scan sector, the results are typical of a planar lens array. The aximuthal plane beamwidth factor is constant (1.0) and the axial plane beamwidth factor varies as the cosine of the scan angle, having a maximum value of 2.0 for ±60 degrees of scan. In the remaining ±60 to ±120-degree scan sector, the beamwidth is characteristic of that which is achievable with a conventional dome antenna. The azimuthal plane beamwidth factor follows inversely as the assumed cos ($|\theta|-60$) gain variation, with a value of 1.0 at ±60 degrees, and gradually increasing to 2.0 at ±120 degrees of scan. The axial plane beamwidth factor is relatively constant, having a maximum value of 2.2, a minimum value of 1.9, and an average value of 2.0 over the ±60- to ±120-degree scan sector. It is significant to point out that the resolution of the dome antenna assembly is within a factor of 2.2 of the broadside feed array resolution for the entire $3\pi$ steradian scan sector.

The characteristics of the specific embodiment are summarized in the following table.

| | |
|---|---|
| Antenna type | dome |
| Coverage sector (deg) | 0 to ± 120 |
| Operating frequency band (GHz) | 10 ± 5% |
| Dome diameter (inch) | 40.3 |
| Number of dome elements | 8980 |
| Feed array diameter (inch) | 28 |
| Number of feed array elements | 1532 |
| Antenna gain (dB) | |
| 0 to ± 60° scan | 33.5 to 30.5 |
| + 60 to ± 120° scan | 29.9 to 25.7 |
| Average power (kw) | 5 |
| Peak power (kw) | 50 |
| Polarization | Linear |
| Peak sidelobe level (dB) (beyond second sidelobe) | −30 |
| Average sidelobe level (dB) | −42 |
| Tracking type | 2-axis monopulse |
| Beamwidth (deg) | 3.0 to 6.6 |
| Feed array type | Optical |
| Phase Shifter type | Reciprocal ferrite with transmission/reflection switch |
| Weight (lb) | 419 |

It will be appreciated by those skilled in the field of the present invention that various additions or modifications to the basic structure disclosed herein can be made. For example, the transmission/reflection switch at each phased array location could be eliminated, and an additional feed and comparator could be placed in front of the phased array lens near the nose of the radome. This configuration would require a microwave switch to provide selection between the two feed/comparator units, and, although introducing some aperture blockage for the forward ±60° scan sector, would provide the desired scan capability for the ±60° to ±120° sector. In another variation of the basic structure as presented in the drawing, polarization could be used to simplify the transmission/reflection switch disclosed. This switch design would be transmissive for one sense of linear polarization, and reflective for the orthogonal sense. In this configuration, a phase shifter, lens element, and feed/comparator unit operable in either polarization sense would be required.

The novel antenna configuration of the present invention, in any of its described embodiments, may be adaptable to nose or tail radome installations of existing high performance aircraft, with appropriate modifications to the aircraft radome structure to support the dome antenna, to provide desired cooling, and to facilitate maintenance and repair.

The present invention, as hereinabove described, provides a low cost, lightweight, phased array dome antenna configuration characterized by increased gain, resolution, and wide scan angle capability, as compared to existing antenna configurations. It is understood that certain modifications may be made to the described embodiments within the scope of the appended claims. Therefore, all embodiments contemplated hereunder have not been shown in complete detail. Other embodiments may be developed without departing from the spirit of this invention or from the scope of the appended claims.

I claim:

1. An antenna arrangement for directing a collimated beam of radio frequency energy, such arrangement comprising the combination of:

a stationary, dome lens antenna having substantially ogive geometry;

a beam forming means, including a feed horn, situated at the zenith of said dome antenna for forming a beam of radio frequency energy;

a phased array antenna situated at the opening of said dome, said phased array antenna fed by said beam of radio frequency energy and having beam directing means for creating a transmission mode of operation whereby a beam of radio frequency energy is produced in free space, or, alternately, for creating a reflection mode of operation whereby a beam of radio frequency energy is produced and directed into said dome whereby said beam undergoes refraction as it propagates through said dome lens antenna and into free space.

2. The antenna arrangement according to claim 1, wherein said beam directing means is composed of a plurality of radiating elements, each element having a controllable electronic phase shifter in tandem with a switch; and wherein said lens antenna is composed of discrete elements.

3. The antenna arrangement according to claim 2 wherein said phase shifter and said switch includes a latching reciprocal ferrite phase shifter employing Faraday rotation in tandem with a Faraday rotator ferrite switch whereby the radio frequency energy propagates through both the phase shifter and the switch in said transmission mode of operation, and, alternately the switch effectively places a short circuit across the output of the phase shifter to direct the radio frequency energy into the dome lens antenna in the reflection mode of operation.

4. The antenna arrangement according to claim 3 wherein said transmission mode of operation includes means for creating an angular scanning coverage from zero to ±60 degrees as measured from an axis drawn perpendicular to said phased array antenna and passing through said beam forming means with its origin at said beam forming means.

5. The antenna arrangement according to claim 4 wherein said reflection mode of operation includes means for creating a second angular scanning coverage from ±60 degrees to ±120 degrees as measured from said axis.

6. The antenna arrangement according to claim 5 wherein said beam forming means includes a feed horn with a sum channel and two difference channels.

7. The antenna arrangement according to claim 6, further including a radome substantially enclosing said dome antenna, said beam forming means, and said phased array antenna and adaptable for use on the nose of an aircraft.

* * * * *